US007210954B2

(12) United States Patent
Ohki et al.

(10) Patent No.: US 7,210,954 B2
(45) Date of Patent: May 1, 2007

(54) ELECTRICAL CONNECTOR PLUG WITH LOCK SCREWS

(75) Inventors: Yasuo Ohki, Tokyo (JP); Yasuo Omori, Tokyo (JP)

(73) Assignee: Honda Tsushin Kogyo Co., Ltd., Tokyo (JP)

( * ) Notice: Subject to any disclaimer, the term of this patent is extended or adjusted under 35 U.S.C. 154(b) by 0 days.

(21) Appl. No.: 11/389,165

(22) Filed: Mar. 27, 2006

(65) Prior Publication Data

US 2006/0223357 A1 Oct. 5, 2006

(30) Foreign Application Priority Data

Mar. 30, 2005 (JP) ..... 2005-097957

(51) Int. Cl.
*H01R 13/627* (2006.01)

(52) U.S. Cl. ..... 439/362

(58) Field of Classification Search ..... 439/362, 439/364

See application file for complete search history.

(56) References Cited

U.S. PATENT DOCUMENTS 5,716,236 A * 2/1998 O'Sullivan et al. ..... 439/610
6,017,245 A * 1/2000 Karir ..... 439/610
6,059,599 A * 5/2000 Huang ..... 439/362
6,179,622 B1 * 1/2001 Lai et al. ..... 439/64
7,052,304 B2 * 5/2006 Yoshida ..... 439/362

FOREIGN PATENT DOCUMENTS

JP 5-72069 9/1993

* cited by examiner

*Primary Examiner*—Neil Abrams
*Assistant Examiner*—Phuongchi Nguyen
(74) *Attorney, Agent, or Firm*—Wenderoth, Lind & Ponack, L.L.P.

(57) ABSTRACT

To form a ground path to ground in a metal shell of an electrical connector plug with lock screws to have a simple structure of a connector housing having secure and durable performance, the connector plug includes an insulative connector housing having a rectangular body on which contacts are arranged, and locking sections extending out to two lateral portions of the body, metal lock screws inserted through screw holes formed in the locking sections, and a metal shell for electrically covering the connector housing. The shell covers the locking sections, through-holes for inserting the lock screws are formed in the shell in positions facing the screw holes, and a contact surface against which the relevant lock screw partially contacts is secured for electrical shielding around one side of each of the through-holes.

6 Claims, 7 Drawing Sheets

ELECTRICAL CONNECTOR PLUG WITH LOCK SCREWS

BACKGROUND OF THE INVENTION

1. Field of the Invention

The present invention relates to a plug for an electrical connecter with lock screws, for example, configured in a way that a connection condition is firmly maintained by screw clamping.

2. Related Art

In an electrical connecter having a metal shell to protect against EMI and which is used for connection of a personal computer, LAN device, measuring instrument or the like, an insulative connector housing is covered with a metal shell as an electrical shield, and electrical connection between respective shells at a receptacle side and a plug side of the electrical connector is established by directly contacting parts of the shells to each other. As a receptacle mounted on a printed circuit board, a receptacle is known, in which a metal shell is electrically connected by a screw, to a conductive nut fitted in a through-hole of a housing body of the receptacle and a metal sheet member, and when the receptacle is mounted on the printed circuit board, the shell is grounded to a conductive portion of the relevant printed circuit board (refer to JP-U-5-72069).

However, since a plug to be connected to the receptacle for the electrical connector is of a structure where the electrical connection is established by contacting the shells to each other when contacts are engaged with each other, an electrical connection condition of the plug is not necessarily secure, and may deteriorate due to aging. Furthermore, even in a type of an electrical connector with a lock screw, while mechanical connection between the receptacle and the plug is secure and firm by the screw and a nut, connection between respective shells of the receptacle and the plug is made by partially butting the relevant shells against each other, which is insufficient in secureness.

SUMMARY OF THE INVENTION

In view of the above problems in the conventional plug, an object of the invention is to provide an electrical connector plug with lock screws in which, in the receptacle and the plug of the electrical connector, a secure electrical conduction path can be ensured in addition to an electrical conduction path by direct contact between the shells for covering the connector housings.

Thus, an electrical connector plug according to the invention is configured to include an insulative connector housing having a rectangular body on which contacts are arranged, and locking sections extending out to two lateral portions of the body, metal lock screws inserted through screw holes formed in the locking sections, and a metal shell for electrically covering the connector housing; wherein the shell covers the locking sections, and through-holes for inserting the lock screws are formed in the shell in positions facing the screw holes, and a contact surface against which the relevant lock screw partially contacts is secured for electrical shielding around one side of each of the through-holes.

The screw holes in the locking sections are preferably configured in a way such that, when the lock screws are inserted through the holes, front ends of the lock screws act as taps to form thread grooves.

According to the electrical connector plug of the invention, once the relevant electrical connector plug is fitted in an electrical connector receptacle as the other connector and thus connected to the receptacle, and the lock screws are clamped in nuts at a side of the receptacle, the shell covering the body comes into contact with a shell of the electrical connector receptacle and is thus electrically connected thereto, and firm connection is achieved through clamping the lock screws with the nuts at the receptacle side. The lock screws are clamped respectively in the locking sections of the connector plug, such that a part of the relevant lock screw such as an end face of a grip of the lock screw or washer tightly contacts against a contact surface around a through-hole of the shell that covers a front side of the locking section, and consequently the shell, lock screw, and nut at the receptacle side are electrically connected. The shell at the receptacle side is electrically connected to the nut, and the shell at the plug side is electrically connected to the shell at the receptacle side therethrough. The shell at the receptacle side is grounded to the ground of a printed circuit board, and the whole electrical connector including the plug and the receptacle is electrically shielded therethrough.

In this way, for the receptacle and the plug for the electrical connector, a secure electrical conduction path is newly ensured by the lock screw and the nut in addition to the electrical conduction path by direct contact between the shells for covering the connector housings.

DETAILED DESCRIPTION OF THE PREFERRED EMBODIMENTS

Figure 1A:
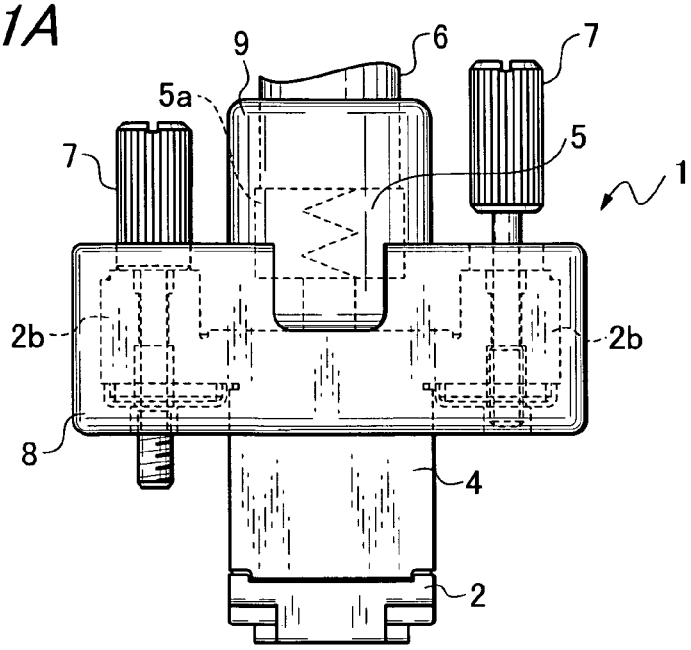
FIGS. 1A, 1B, 1C and 1D are plan, front, back and right side views showing respectively an electrical connector plug with lock screws, according to an embodiment of the invention.
Figure 1B:
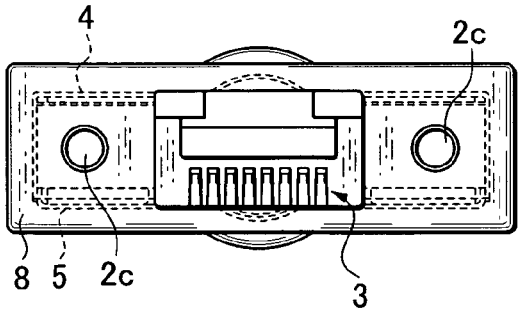
Figure 1C:
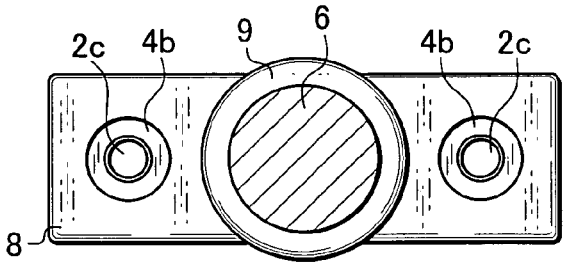
Figure 1D:
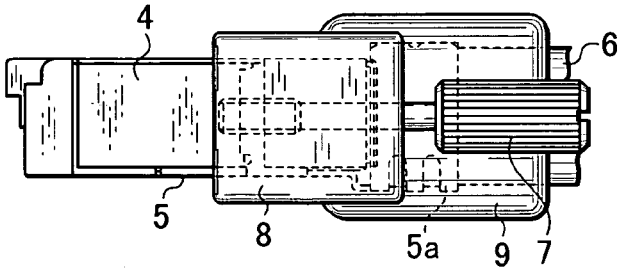
Figure 2A:
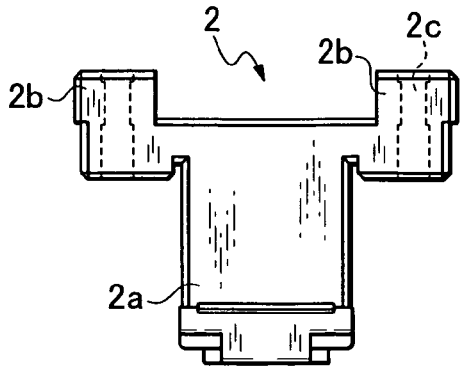
FIGS. 2A, 2B, 2C, 2D and 2E are plan, front, back, right side and bottom views showing respectively a connector housing of the electrical connector plug of the embodiment.
Figure 2B:
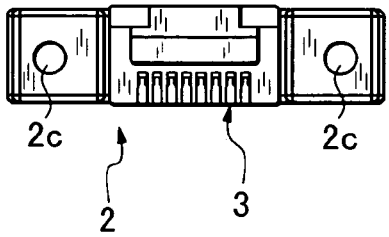
Figure 2C:
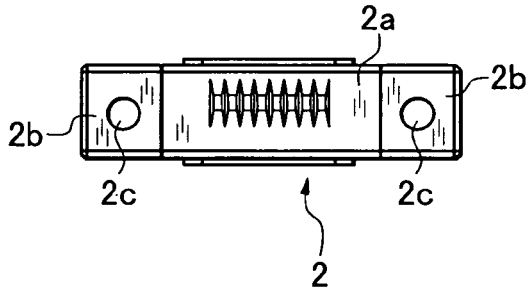
Figure 2D:
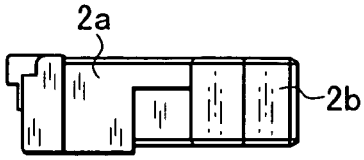
Figure 2E:
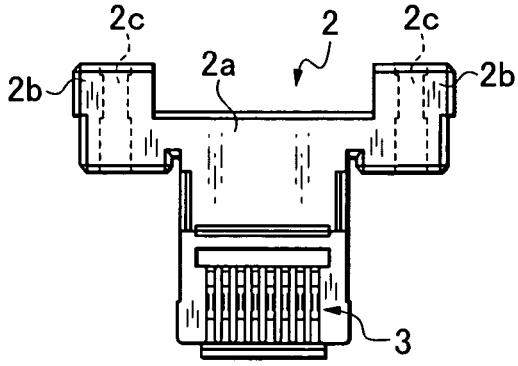
Figure 3A:
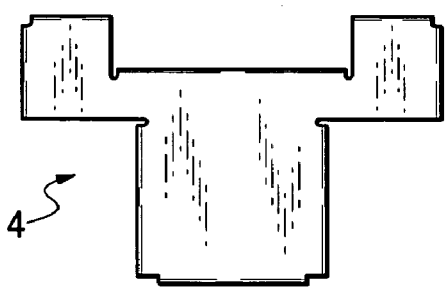
FIGS. 3A, 3B, 3C, 3D and 3E are plan, front, back, right side and bottom views showing an upper shell of the electrical connector plug of the embodiment.
Figure 3B:
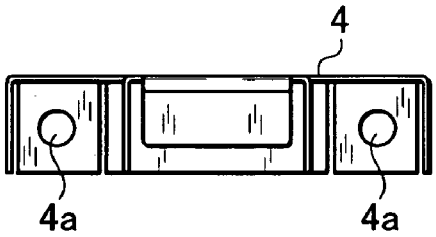
Figure 3C:
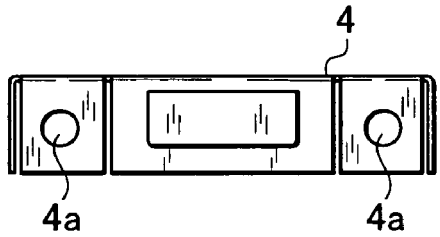
Figure 3D:
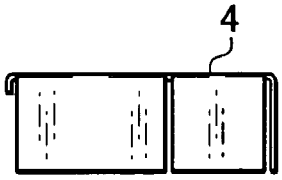
Figure 3E:
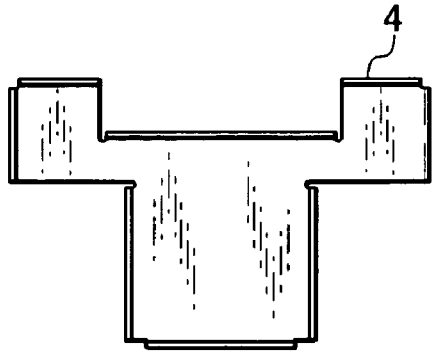
Figure 4A:
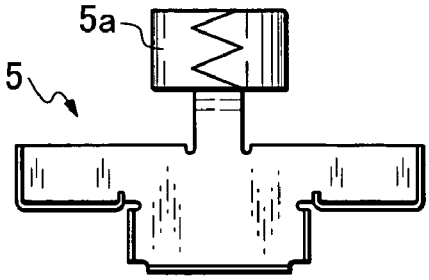
FIGS. 4A, 4B, 4C, 4D and 4E are plan, front, back, right side and bottom views showing respectively a lower shell of the electrical connector plug of the embodiment.
Figure 4B:
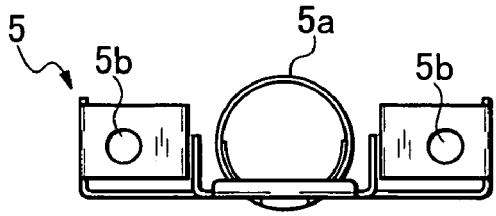
Figure 4C:
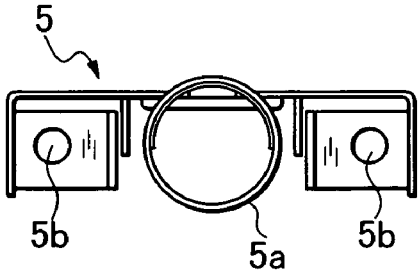
Figure 4D:
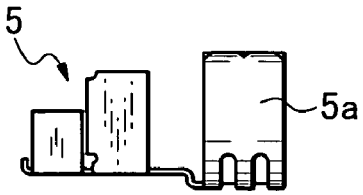
Figure 4E:
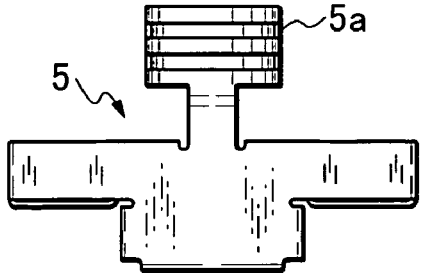

As shown in FIG. 1A to FIG. 1D, an electrical connector plug 1 according to an embodiment of the invention generally includes an insulative synthetic-resin connector housing 2; a plurality of contacts 3 lined on the connector housing 2;

an upper shell 4 and a lower shell 5 for electrically covering the connector housing 2; a cable 6 having a shielded wire (braded net wire) that is folded back to the outside of the cable and then fixed to a clasp 5*a* of the lower shell 5 by calking; metal lock screws 7 inserted through screw holes 2*c* provided in locking sections 2*b* in lateral portions of the connector housing 2; and a housing cover 8 and a cable cover 9, which are formed by insert molding such that they partially cover the locking sections 2*b* and the upper and lower shells 4 and 5, and cover an end portion of the cable 6.

As shown in FIGS. 2A to 2E, the connector housing 2 has a central, rectangular body 2*a*, and locking sections 2*b* extending out from rear ends of the body to both sides. A front end of the body 2*a* is a portion to be attached to a fitting portion of a receptacle as another connector, on which contacts 3 for connection are disposed parallel to one another. In the locking sections 2*b*, screw holes 2*c* running through the sections in a back and forth direction are formed respectively. A portion having a reduced hole-diameter is formed at a rear end side of each screw hole 2*c*, and when the metal lock screw 7 is first inserted through the screw hole 2*c*, a front end of the lock screw acts as a tap to form a thread groove. Therefore, after the lock screw 7 is screwed into the screw hole 2*c* and then inserted through the hole, it is retained and held by the relevant lock screw hole 2*c*.

The upper shell 4 and the lower shell 5 cover the body 2*a* and the locking sections 2*b* of the connector housing 2, and are integrally molded as shown in FIG. 3A to FIG. 4E. Holes 4*a* and 5*b* for inserting the lock screws 7 are formed in portions for covering the locking sections 2*b* respectively.

Figure 5A:
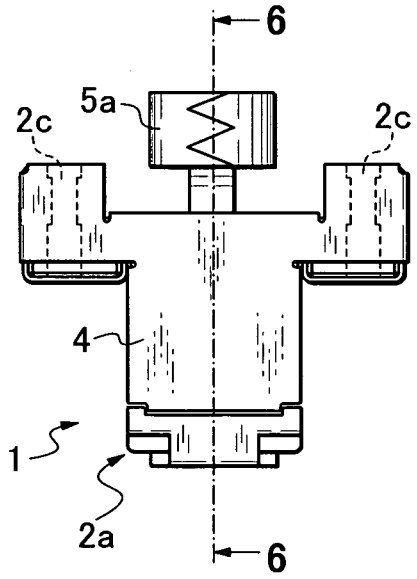
FIGS. 5A, 5B, 5C, 5D and 5E are plan, front, back, right side and bottom views showing respectively a condition where upper and lower shells are attached a connector housing.
Figure 5B:
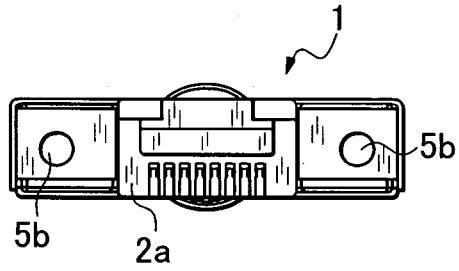
Figure 5C:
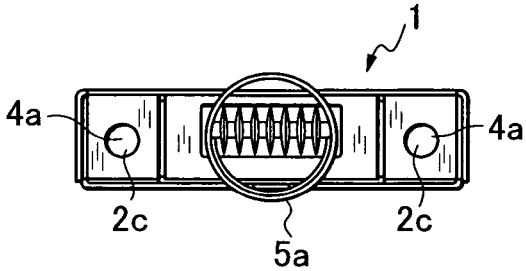
Figure 5D:
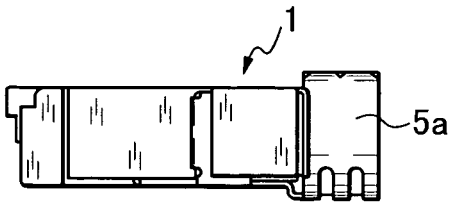
Figure 5E:
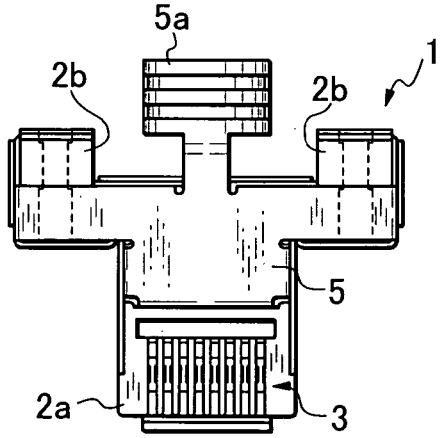
Figure 6:
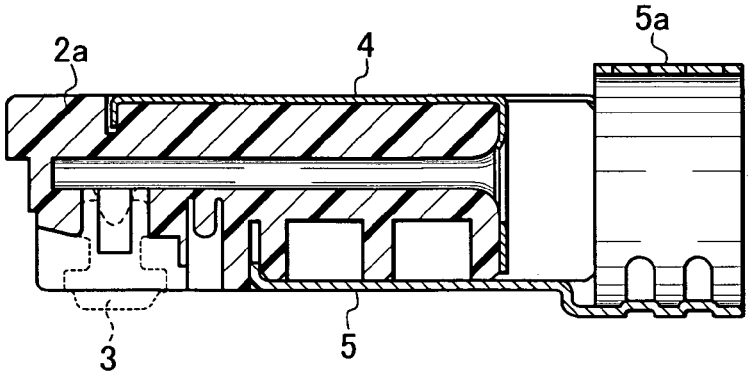
FIG. 6 is a cross section view along a line 6—6 in FIG. 5A.

As shown in FIG. 5A to FIG. 6, the upper shell 4 and the lower shell 5 are attached to the connector housing 2 to cover the housing, and then the cable 6, having element wires respectively connected to the contacts 3, is run through the clasp 5*a* of the lower shell 5, and then the braded net wire is folded back to the outside and then fixed to the clasp by calking.

Figure 7A:
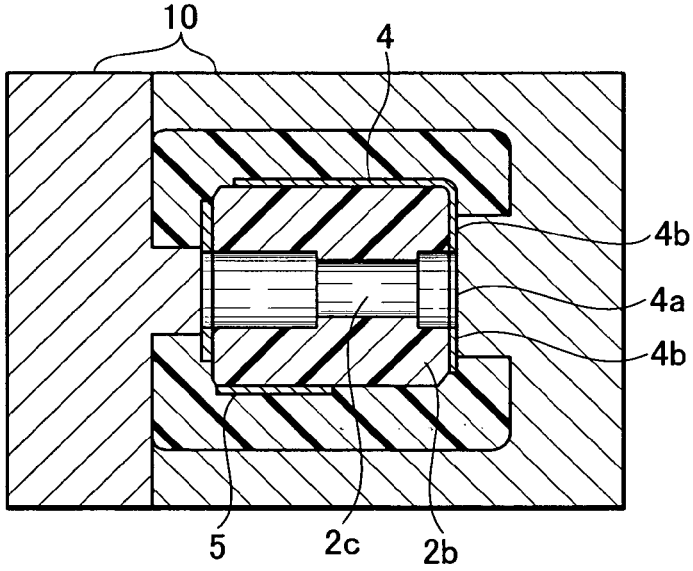
FIG. 7A is a cross section view partially showing an aspect that the electrical connector plug is subjected to insert-molding.
Figure 7B:
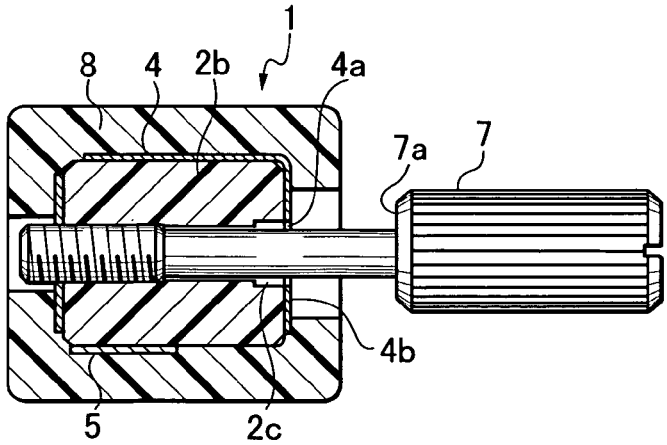
FIG. 7B is a cross section view of the connector plug after the molding.

Next, the connector plug 1 in a condition where the shells 4, 5 and the cable 6 are attached to the connector housing 2 is disposed in a die 10 as shown in FIG. 7A. At that time, the die 10 is designed such that the screw hole 2*c* and the hole 4*a* are not plugged in the locking section 2*b* of the connector housing 2, and a contact surface 4*b* is secured around the hole 4*a* so that an end face 7*a* of a grip of a lock screw 7 can contact against an extended portion of the upper shell 4.

In addition to this, a case in which the contact surface 4*b* is secured by a spring strip folded inside the hole 4*a* is also acceptable. In this case, part of the lock screw 7 may include a flange integrated with the lock screw, or a separate washer, pipe or the like fitted with the relevant lock screw.

Figure 8:
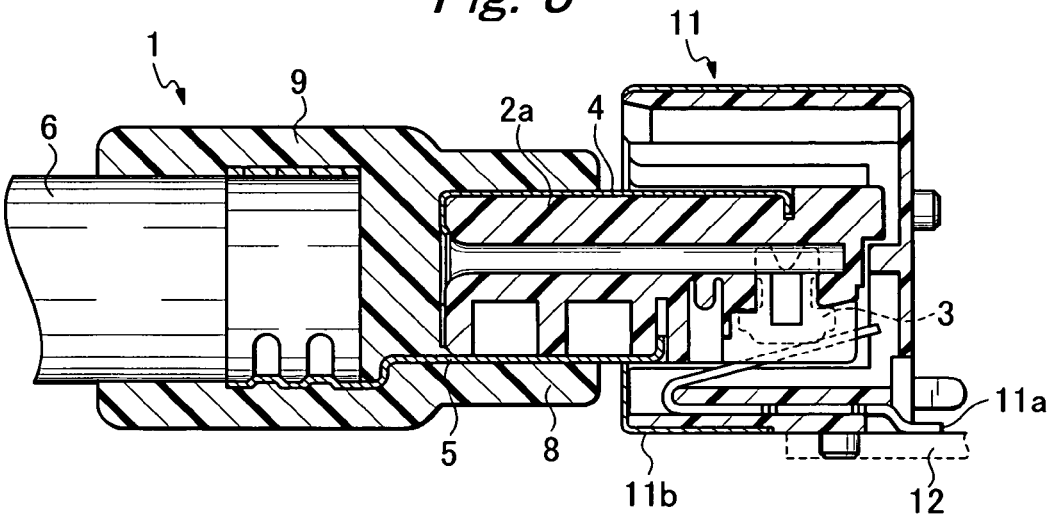
FIG. 8 is a cross section view showing a use situation of the electrical connector plug of the embodiment.

Then, melted resin is caused to flow into a cavity of the die to form a housing cover 8 and a cable cover 9. In this way, the electric connector plug 1 is completed. In usage of the plug 1, as shown in FIG. 8, for example, the plug is connected to a connector receptacle 11 as the other connector in a modular arrangement, wherein the contacts 3 of the plug 1 are connected to contacts 11*a* at a receptacle side, and the shells 4, 5 at a plug 1 side contact against a shell 11*b* and the like at the receptacle 11 side and are thus connected thereto, and consequently grounded to the ground of a printed circuit board 12 on which the receptacle 11 is mounted.

Figure 9:
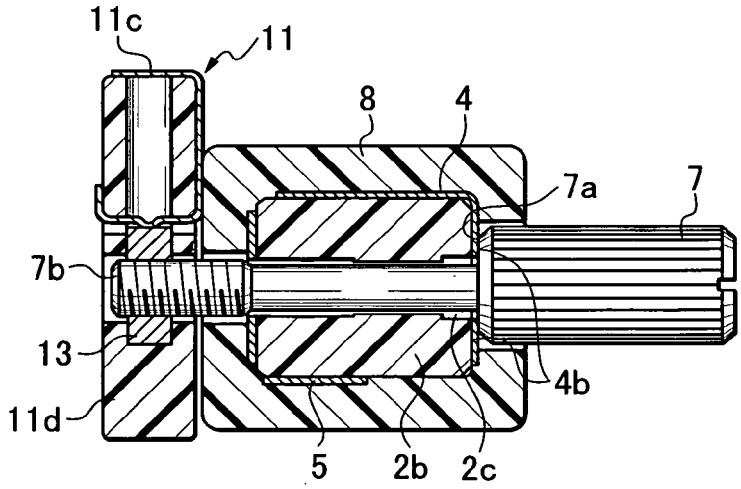
FIG. 9 is a cross section view partially showing the use situation of the electrical connector plug of the embodiment.
Figure 10:
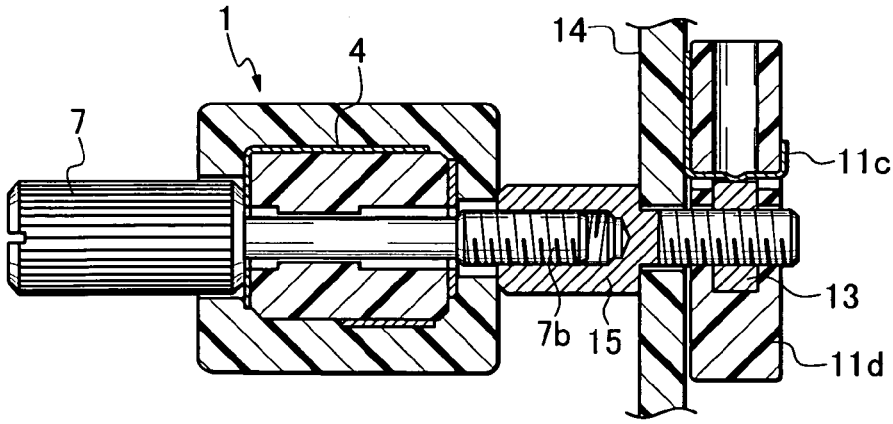
FIG. 10 is a cross section view showing a use situation of an electrical connector plug with lock screws according to another embodiment.

Furthermore, as shown in FIG. 9, the lock screw 7 is clamped to a lock nut 13 of the receptacle as the other connector. In this manner, the end face 7*a* of the grip firmly contacts against the contact surface 4*b* of the upper shell 4, and the front end 7*b* of the lock screw is connected to a nut 13 of a locking section 11*d* at the receptacle side. The nut 13 contacts against a shell 11*c* at the receptacle side and is thus connected thereto. As a result, the shell 4 is electrically connected to the shell 11*c*, resulting in formation of an electrical shield. In this way, in addition to a shield path by direct contact between the shells 4 and 11*c*, a shield path via the lock screw 7 and the nut 13 is formed, which guarantees secureness. When a panel 14 is interposed between the plug and the receptacle as shown in FIG. 10, an offset screw 15 is preferably disposed at a front-end side of the lock screw 7 for screw clamping. Thus, a new shield path is secured by the lock screw 7 and the nut 13 as in the case of FIG. 9.

What is claimed is:

1. An electrical connector plug for connecting to an electrical connector receptacle having electrical receptacle contacts, a metal electrical receptacle shell, and nuts electrically connected with the metal electrical receptacle shell, said electrical connector plug comprising:

an insulative connector housing having a central rectangular body, and two locking sections extending laterally in opposite lateral directions from said central rectangular body, said two locking sections having screw-receiving holes formed respectively therethrough;

electrical plug contacts mounted to said central rectangular body of said insulative connector housing for electrically contacting with the electrical receptacle contacts of the electrical connector receptacle; and a metal electrical connector plug shell electrically covering both said central rectangular body of said insulative connector housing and said locking sections of said insulative connector housing;

wherein said metal electrical connector plug shell includes contact surfaces respectively having screw-receiving through-holes therein, said contact surfaces being configured so that said screw-receiving through-holes thereof are respectively aligned with said screw-receiving holes formed in said locking sections; and wherein metal lock screws respectively extend through said screw-receiving holes formed in said locking sections and respectively extend through said screw-receiving through-holes formed in said contact surfaces of said metal electrical connector plug shell, such that said metal lock screws respectively electrically contact said contact surfaces of said metal electrical connector plug shell and are configured and arranged to threadedly engage in the nuts of the electrical connector receptacle in order to secure said electrical connector plug to the electrical connector receptacle and provide an electrical conduction path from said metal electrical connector plug shell to the metal electrical receptacle shell via said lock screws and the nuts.

2. An electrical connector plug according to claim 1, wherein respective portions of said screw-receiving holes formed in said locking sections constitute screw-tapped portions having thread grooves self-tapped by leading ends of said lock screws.

3. An electrical connector plug according to claim 1, wherein a leading end portion of said central rectangular body of said insulative connector housing constitutes a male plug portion configured to be received by a female receptacle portion of the electrical connector receptacle.

4. An electrical connector plug according to claim 1, wherein said metal lock screws have longitudinal axes extending perpendicular to said lateral directions in which said locking sections of said insulative connector housing extend from said central rectangular body of said insulative connector housing.

5. An electrical connector plug according to claim 1, wherein said metal electrical connector plug shell comprises an upper metal shell covering an upper part of said insulative connector housing, and a lower metal shell covering a lower part of said insulative connector housing;

said contact surfaces of said metal electrical connector plug shell respectively comprise upper shell contact surfaces of said upper metal shell and lower shell contact surfaces of said lower metal shell; and said screw-receiving through-holes of said contact surfaces of said metal electrical connector plug shell respectively comprise upper shell screw-receiving through-holes formed in said upper shell contact surfaces of said upper metal shell, and lower shell screw-receiving through-holes formed in said lower shell contact surfaces of said lower metal shell and aligned with said upper shell screw-receiving through-holes.

6. An electrical connector plug according to claim 5, wherein said metal lock screws have longitudinal axes extending perpendicular to said lateral directions in which said locking sections of said insulative connector housing extend from said central rectangular body of said insulative connector housing.

* * * * *